US006077101A

United States Patent [19]

Garretson et al.

[11] Patent Number: 6,077,101

[45] Date of Patent: Jun. 20, 2000

[54] ELECTRONIC CONNECTOR WITH CPA DEVICE

[75] Inventors: Jay Harold Garretson; Richard James Polenick, both of Warren, Ohio; John Marvin Chupak, West Middlesex, Pa.; William Gilbert Strang, Warren, Ohio

[73] Assignee: General Motors Corporation, Detroit, Mich.

[21] Appl. No.: 08/972,289

[22] Filed: Nov. 18, 1997

[51] Int. Cl.[7] ..... H01R 13/62

[52] U.S. Cl. ..... 439/352

[58] Field of Search ..... 439/352, 357, 439/489, 350, 351, 353, 554–8, 488–91

[56] References Cited

U.S. PATENT DOCUMENTS

| | | |
|---|---|---|
| 4,746,306 | 5/1988 | Yurtin et al. . |
| 4,906,204 | 3/1990 | Metzger . |
| 4,946,395 | 8/1990 | Cope et al. . |
| 4,946,402 | 8/1990 | Fink et al. . |
| 5,026,298 | 6/1991 | Brussalis et al. . |
| 5,120,255 | 6/1992 | Kouda et al. . |
| 5,605,471 | 2/1997 | Plyler . |

*Primary Examiner*—Steven L. Stephan
*Assistant Examiner*—Eugene G. Byrd
*Attorney, Agent, or Firm*—Patrick M. Griffin

[57] ABSTRACT

An electrical connector has a socket connector body that has a lock ramp, a plug connector body that mates with the socket connector body and that has a lock arm that engages the lock ramp of the socket connector body to lock the plug and socket connector bodies together when the connector bodies are mated, and a connector position assurance (CPA) device that is slideably retained on the plug connector body for assuring that the connector bodies are properly mated and locked together. The CPA device has a top wall and depending sidewalls at respective longitudinal edges of the top wall that overlap and slide on spaced side walls of the plug connector body. The lock arm is between the sidewalls of the plug connector body and connected to the side walls midway between its ends to provide a release lever. The top wall of the CPA device has a depending pusher portion at one end for pushing the lock arm into engagement with the lock ramp and a target portion at the opposite end of the top wall for applying a force to the CPA device. The CPA device is retained in a first detent or pre-stage position and a second detent position with respect to the plug connector. The top wall of the CPA device has a release lever that operates the release lever of the lock arm when the CPA device is in the pre-stage position and the target portion of the CPA device has a strap that disables the release lever of the lock arm when the CPA device is in the second detent position.

13 Claims, 2 Drawing Sheets

ELECTRONIC CONNECTOR WITH CPA DEVICE

TECHNICAL FIELD

This invention relates generally to electrical connectors and more particularly to electrical connectors that are equipped with a connector position assurance (CPA) device that assures that the electrical connectors are properly mated and locked together.

BACKGROUND OF THE INVENTION

Existing CPA devices are typically loose pieces that operate as wedges that keep the mated electrical connectors locked to each other. See for instance, U.S. Pat. No. 4,746,306 granted to John A. Yurtin et al. May 24, 1988, which discloses a pin-like CPA device for electrical connectors that is wedged into a gauge hole that exists only if the electrical connectors are properly mated and locked together. U.S. Pat. No. 4,906,204 granted to John R. Metzger Mar. 6, 1990, and U.S. Pat. No. 4,946,402 granted to Randy L. Fink et al. Aug. 7, 1990, show similar arrangements.

While these CPA devices have been used successfully, the CPA devices have a common drawback in that the CPA devices are loose pieces that can be lost or ignored in the assembly process.

U.S. Pat. No. 4,946,395 granted to Kenneth P. Cope et al. Aug. 7, 1990; U.S. Pat. No. 5,026,298 granted to Stacy A. Brussalis et al. Jun. 25, 1991; U.S. Pat. No. 5,120,255 granted to Tomoyuki Kouda et al. Jun. 9, 1992, and U.S. Pat. No. 5,605,471 granted to Robert G. Plyler Feb. 25, 1997, disclose CPA devices that are slideably retained on the connector body of one of the matable electrical connectors thus avoiding many of the problems associated with CPA devices that are loose pieces.

While some of these CPA devices have been used successfully, further improvements are still desirable and possible.

SUMMARY OF THE INVENTION

The object of this invention is to provide an electrical connector that includes a CPA device that is slideably retained on the connector body of one of the electrical connectors and that has one or more of the following features.

A feature of the invention is that the CPA device is mounted exteriorly on the connector body of one electrical connector to provide a pleasing appearance.

Another feature of the invention is that the exteriorly mounted CPA device has a wide projection-free outer surface to provide a pleasing appearance and avoid snagging.

Still another feature of the invention is that the CPA device has a pusher portion that is attached to a thin flexible wall of the CPA device to permit vertical movement of the pusher portion while avoiding projections that could cause snagging.

Yet another feature of the invention is that the CPA device is particularly well suited for electrical connectors having a lock arm that pivots outward on a connector body midway between it ends to provide a release lever.

Still another feature of the invention is that the CPA device disables the release lever of the lock arm when the connectors are properly mated and locked together.

Still another feature of the invention is that the CPA device assists in disconnecting electrical connectors that are mated and locked together.

Still yet another feature of the invention is that CPA device has structure that provides strong resistance against the CPA device being pulled off the connector body on which it is slideably retained.

These and other objects, features and advantages of the invention will become apparent from the description below, which is given by way of example with reference to the accompanying drawings.

DESCRIPTION OF THE PREFERRED EMBODIMENT

Figure 1:
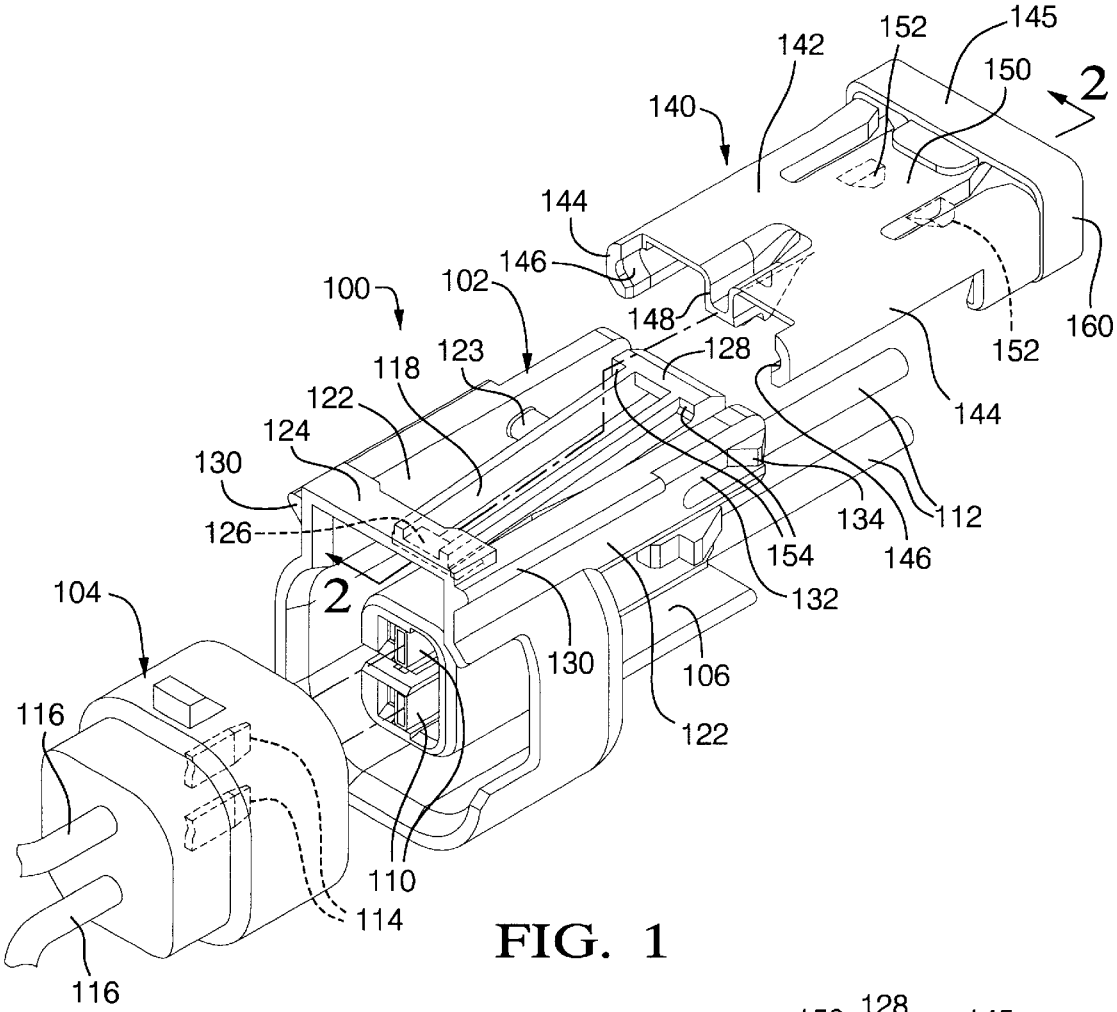
FIG. 1 is an exploded perspective view of an electrical connector equipped with a CPA device in accordance with the present invention.

Referring to FIG. 1, the electrical connector assembly 100 comprises a plug connector 102 and a socket connector 104 that mate and establish an electrical connection in a well known manner. Plug connector 102 comprises a connector body 106 that plugs into connector body 108 of socket connector 104. Connector body 106 contains terminals 110 attached to the ends of electrical leads 112. Terminals 110 mate with terminals 114 in connector body 108 that are attached to the ends of electrical leads 116 when connector body 106 is plugged into connector body 108.

When mated, the plug and socket connectors 102 and 104 are locked together by lock arm 118 of connector body 106 engaging a lock ramp 120 of connector body 108. Lock arm 118 is located between two spaced upright side walls 122 of connector body 106 that are joined by a cross bar 124 at the forward end. Lock arm 118 has a longitudinal slot that extends from a lock bar 126 at a forward end to a stop bar 128 at a rearward end. Lock arm 118 is attached to side walls 122 by torsion pin portions 123 that twist resiliently so that lock arm 118 can pivot like a teeter-totter. Pin portions 123 are midway between forward lock bar 126 and rearward stop bar 128 so that the forward portion of lock arm 118 pivots outwardly when the forward lock bar 126 engages lock ramp 120 or when the stop bar 128 is depressed with the rearward portion of the lock arm 118 acting as a release lever.

Each side wall 122 has a forward lateral rail 130 that extends outwardly and a rearward slot that provides a laterally flexible lock arm 132 that includes a lock ramp 134 that extends outwardly.

The electrical connector assembly 100 also includes a connector position assurance (CPA) device 140 that insures that the socket and plug connectors 102 and 104 are properly mated and locked together. CPA device 140 is slideably retained on connector body 106 and cooperates with lock arm 118 and lock rampl20 as explained below.

CPA device 140 comprises a generally flat top wall 142 with depending side wallsl44 at the respective longitudinal edges. Top wall 142 has a wide outer surface that extends between and merges smoothly into side walls 144. The outer surface is also projection-free to provide a pleasing appearance and avoid snagging. Each side wall 144 has an inwardly facing longitudinal groove 146 that receives one of the lateral rails 130 of connector body 106 so that the CPA device 140 slides on connector body 106 in a longitudinal direction.

Top wall 142 has a depending pusher portion 148 at the forward end and the front portion of top wall 142 that carries the pusher portion 148 is thin to provide sufficient flexibility for the depending pusher portion 148 to be moved vertically with respect to the side walls 144 in the connection sequence as explained below.

Top wall 142 has two laterally spaced longitudinal slots in the rearward portion that form a depressible release lever 150 that is connected to the rearward portions of side walls 144 by a thin, flexible strap 145. Lever 150 includes two laterally spaced lock nibs 152 that extend inwardly in alignment with stop shoulders 154 on the face of stop bar 128. Lock nibs 152 snap over and engage stop shoulders 154 when CPA device 140 is assembled to the connector body 106 so that the CPA device 140 is slideably retained on connector body 106. Two lock nibs 152 engage two stop shoulders 154 in a flat perpendicular engagement to provide a strong resistance against CPA device 140 being pulled off connector body 106.

The rearward portions of side walls 144 are deeper to accommodate a second inwardly facing groove that is below the slide groove 146 and that includes a lock nib 156 with forward and rearward slanted faces. Forward faces of lock nibs 156 engage rearward faces of lock ramps 134 of connector body 106 when CPA device 140 is assembled to the connector body 106. Thus CPA device 140 is retained in a first detented or "pre-staged" position by lock nibs 152 and stop shoulders 154 of stop bar 128 in one direction, i.e. the pull-off direction and in the opposite push on direction by lock nibs 156 and lock ramps 134. The deeper rearward portions of side walls 144 are connected by a relatively rigid cross strap 158.

Figure 2:
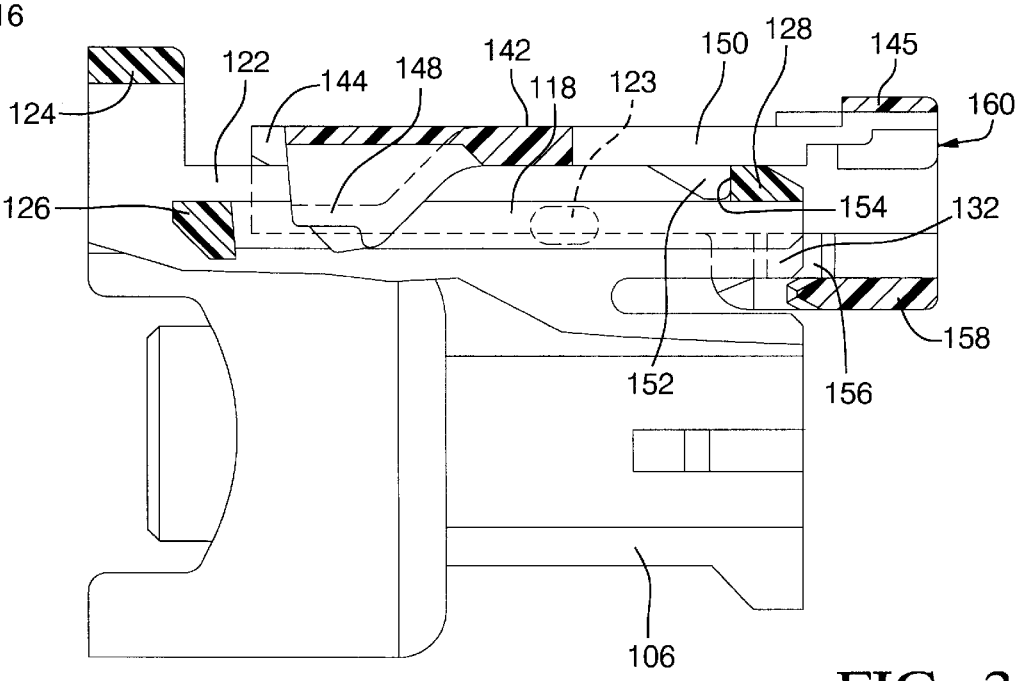
FIG. 2 is a longitudinal section of the electrical socket connector shown in FIG. 1 with the CPA device slideably retained on the connector body in a "pre-staged" position.

The first detented or pre-staged position is shown in FIG. 2. In this position CPA device 140 has an annular target portion 160 at the rear end that overhangs connector body 106 as shown in FIG. 2. When plug connector 102 is plugged into socket connector 104, CPA device 140 is pushed forwardly on connector body 106 by applying a thumb force to the annular target portion 160 until the connectors are properly mated and locked together.

Figure 3A:
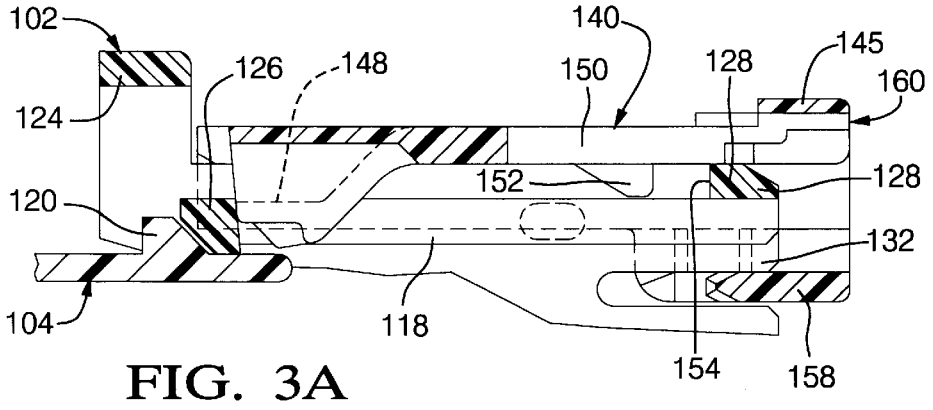
FIG. 3A is a longitudinal section of the electrical connector shown in FIG. 1 with the CPA device pushed forward against the lock arm of the electrical socket connector to initiate the connector locking sequence.
Figure 3B:
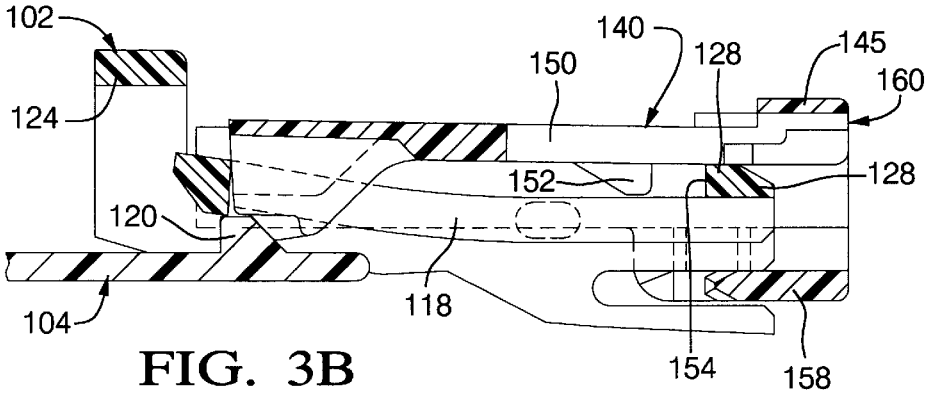
FIGS. 3B, 3C and 3D are longitudinal sections of the electrical connector shown in FIGS. 1 and 3A with the CPA device in various stages during the connector locking sequence.
Figure 3C:
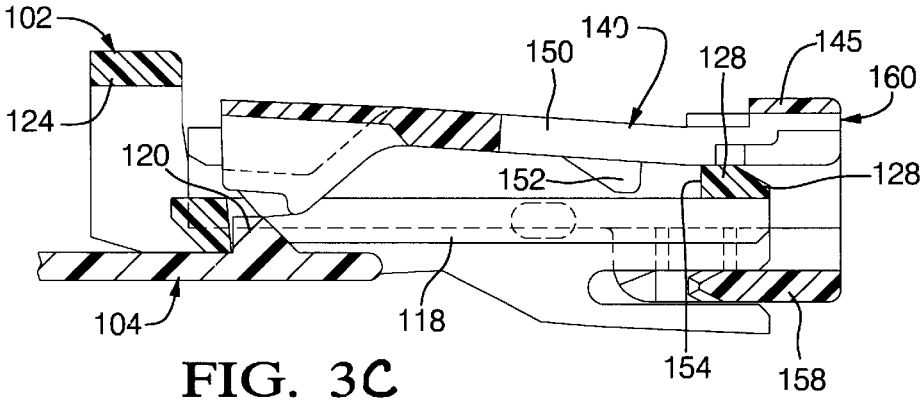
Figure 3D:
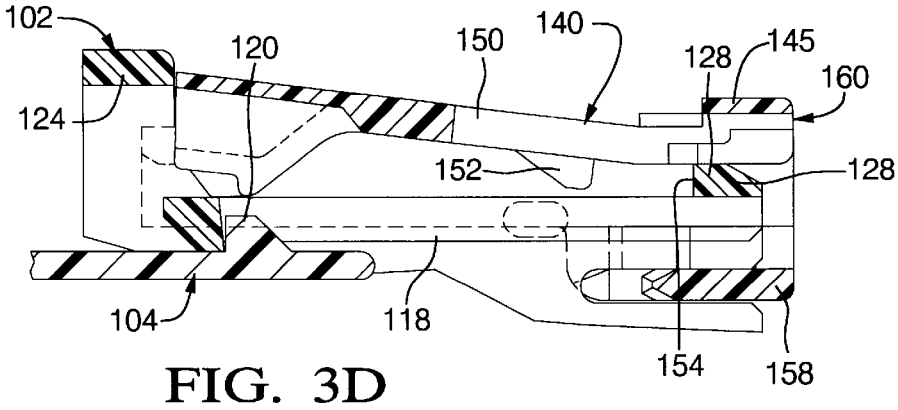

The connection sequence is shown in FIGS. 3A, 3B, 3C and 3D. As the CPA device 140 is pushed forward, pusher portion 148 engages lock bar 126 of lock arm 118 as shown in FIG. 3A if lock bar 126 is not already properly seated behind lock ramp 120 when plug and socket connectors 102 and 104 are mated. Pusher portion 148 then pushes lock bar 126 up onto lock ramp 120 of connector 104 as shown in FIG. 3B. As CPA device 140 continues forwardly, pusher portion 148 is raised by the lock ramp 120 and then disengaged from lock bar 126 when lock bar 126 is pushed to the locked position behind lock ramp 120 as shown in FIG. 3C. Lock bar 126 then engages ramp 162 of pusher portion 148 to raise pusher portion 1.48 out of the lock arm slot and allow pusher portion 148 to continue moving forward until it engages cross bar 124 as shown in FIG. 3D. CPA device 140 is then held in this second detented position by rearward faces of lock nibs 156 engaging forward surfaces of lock ramps 134.

It should be noted that CPA device 140 cannot be pushed to the second detented position unless connectors 102 and 104 are properly mated and locked together with lock bar 126 located behind lock ramp 120. Furthermore in this second detented position where the electrical connectors 102 and 104 are properly mated and locked together, the relatively rigid cross strap 158 is below the rear end of lock arm 118 so that the rearward portion of lock arm 118 cannot act as a release lever and disengage lock bar 126 from lock ramp 120.

When disconnecting connectors 102 and 104, CPA device 140 is pulled back to the first detented or pre-staged position shown in FIG. 2 while the lock bar 126 is still engaged behind lock ramp 120. The rearward portion of lock arm 118 can now act as a release lever because cross strap 158 is positioned behind lock arm 118. Lock bar 126 is then easily disengaged from lock ramp 120 by depressing release lever 150 of CPA device 140 which acts on the rearward portion of lock arm 118 with a mechanical advantage due to the overhanging position of target portion 160. Once lock arm 118 is released, connectors 102 and 104 can be pulled apart easily.

Obviously, many modifications and variations of the present invention in light of the above teachings may be made. It is, therefore, to be understood that, within the scope of the appended claims, the invention may be practiced otherwise than as specifically described.

We claim:

1. An electrical connector comprising;

a first connector body that has a lock ramp, a second connector body that mates with the first connector body and that has a lock arm that engages the lock ramp of the first connector body to lock the first and second connector bodies together when the first and second connector bodies are mated, and a connector position assurance device that is slideably retained on the connector body for assuring that the first and second connector bodies are properly mated and locked together, the connector position assurance device having a top wall and depending side walls at respective longitudinal edges of the top wall, the top wall having a depending pusher portion at one end for pushing the lock arm into engagement with the lock ramp, and the connector position assurance device having a target portion at the opposite end of the top wall for applying a force to the connector position assurance device.

2. The electrical connector as defined in claim 1 wherein the pusher portion depends from a vertically flexible portion of the top wall.

3. The electrical connector as defined in claim 1 wherein each of the depending side walls of the connector position assurance device has a slide groove that faces inwardly, wherein the second connector has a pair of spaced side walls, and wherein each of the side walls of the second connector has a lateral rail that extends outwardly into the slide groove.

4. The electrical connector as defined in claim 1 wherein the lock arm has a lock bar at a forward end and a stop bar at a rearward end and wherein the lock arm is connected to the connector body midway between the forward end and the rearward end to provide a release lever.

5. The electrical connector as defined in claim 4 wherein the connector position assurance device has a first detent or pre-stage position with respect to the second connector and a second detent position with respect to the second connector, and wherein the top wall of the connector position assurance device has a release lever that operates the release lever of the lock arm when the connector position assurance device is in the first detent position.

6. The electrical connector as defined in claim 5 wherein the target portion of the connector position assurance device has a strap that disables the release lever of the lock arm when the connector position assurance device is in the second detent position.

7. The electrical connector as defined in claim 6 wherein the top wall of the connector position assurance device has depending nibs that engage the stop bar of the lock arm to retain the connector position assurance device in the first detent or pre-stage position.

8. The electrical connector as defined in claim 7 wherein each sidewall of the second connector body has a rearward slot that provides a laterally flexible lock arm, wherein each laterally flexible latch arm includes a lock ramp that extends outwardly, and wherein each of the depending side walls of the connector position assurance device includes a lock nib that cooperates with a lock ramp of one of the laterally flexible lock arms to partially retain the connector position assurance device in the first detent position and the second detent position.

9. An electrical connector comprising;

a first connector body that has a lock ramp, a second connector body that mates with the first connector body and that has a lock arm that engages the lock ramp of the first connector body to lock the first and second connector bodies together when the first and second connector bodies are mated, and a connector position assurance device that is slideably retained on the connector body for assuring that the first and second connector bodies are properly mated and locked together, the second connector body having a pair of spaced side walls, each of the side walls having a lateral rail that extends outwardly, the lock arm having a lock bar at a forward end and a stop bar at a rearward end, the lock arm being connected to the side walls of the second connector body midway between the forward end and the rearward end to provide a release lever, the connector position assurance device having a top wall and depending side walls at respective longitudinal edges of the top wall, the top wall having a depending pusher portion at one end for pushing the lock arm into engagement with the lock ramp, each of the depending side walls having a slide groove that receives the lateral rail of one of the slide walls of the second connector body, and the connector position assurance device having a target portion at the opposite end of the top wall for applying a force to the connector position assurance device.

10. The electrical connector as defined in claim 9 wherein the connector position assurance device is retained in a first detent with respect to the second connector and a second detent position with respect to the second connector, and wherein the top wall of the connector position assurance device has a release lever that operates the release lever of the lock arm when the connector position assurance device is in the first detent position.

11. The electrical connector as defined in claim 9 wherein the target portion of the connector position assurance device has a strap that disables the release lever of the lock arm when the connector position assurance device is in the second detent position.

12. The electrical connector as defined in claim 10 wherein the top wall of the connector position assurance device has depending nibs that engage the stop bar of the lock arm to particularly retain the connector position assurance device in a first detent position with respect to the second connector body.

13. The electrical connector as defined in claim 12 wherein each sidewall of the second connector body has a rearward slot that provides a laterally flexible lock arm, wherein each laterally flexible latch arm includes a lock ramp that extends outwardly, and wherein each of the depending side walls of the connector position assurance device includes a lock nib that has a first surface that cooperates with a lock ramp of one of the laterally flexible lock arms to partially retain the connector position assurance device in the first detent position and a second surface that cooperates with the lock ramp to retain the connector position assurance device in a second detent position.

* * * * *